US005855497A

United States Patent [19]

French

[11] Patent Number: 5,855,497

[45] Date of Patent: Jan. 5, 1999

[54] LIFE JACKET WITH FLEXIBLE LIFE LINE

[76] Inventor: Cynthia M. French, Rte. 2 Box 145, Cleveland, Va. 24225

[21] Appl. No.: 44,320

[22] Filed: Mar. 19, 1998

[51] Int. Cl.[6] ..... B63C 9/26

[52] U.S. Cl. ..... 441/84; 441/116; 441/118

[58] Field of Search ..... 441/80, 84, 85, 441/108, 109, 110, 111, 112, 113, 114, 115, 116, 117, 118

[56] References Cited

U.S. PATENT DOCUMENTS

| | | | |
|---|---|---|---|
| 4,187,570 | 2/1980 | De Simone | 441/84 |
| 4,694,772 | 9/1987 | Faulconer et al. | 441/116 |
| 5,393,254 | 2/1995 | Ducheshe | 441/118 |
| 5,603,646 | 2/1997 | Tobias | 441/116 |

*Primary Examiner*—Stephen Avila

[57] ABSTRACT

A new life jacket with flexible life line for allowing a user to have a life line conveniently located on their life jacket so that the line can be easily accessed during a rescue. The inventive device includes a life jacket with a top, a bottom, and front and back floatation panels. The panels define a pair of side spaces between them which are each adapted for extending an arm therethrough. A flexible pouch having an interior compartment and an top opening into the interior compartment is coupled to the front and back floatation panels. A length of flexible line having opposite ends is disposable in the interior compartment of the pouch such that the ends of the flexible line are extended from the pouch. One of the ends of the flexible line has a fastening clip coupled thereto which is detachably attachable to a portion of the life jacket for securing the one end of the flexible line to the life jacket.

4 Claims, 1 Drawing Sheet

LIFE JACKET WITH FLEXIBLE LIFE LINE

BACKGROUND OF THE INVENTION

1. Field of the Invention

The present invention relates to life jackets and more particularly pertains to a new life jacket with flexible life line for allowing a user to have a life line conveniently located on their life jacket so that the line can be easily accessed during a rescue.

2. Description of the Prior Art

The use of life jackets is known in the prior art. More specifically, life jackets heretofore devised and utilized are known to consist basically of familiar, expected and obvious structural configurations, notwithstanding the myriad of designs encompassed by the crowded prior art which have been developed for the fulfillment of countless objectives and requirements.

Known prior art life jackets include U.S. Pat. No. 5,326,297; U.S. Pat. No. 5,429,539; U.S. Pat. No. Des. 260,162; U.S. Pat. No. 4,721,487; U.S. Pat. No. 5,452,487; and U.S. Pat. No. 5,230,645.

While these devices fulfill their respective, particular objectives and requirements, the aforementioned patents do not disclose a new life jacket with flexible life line. The inventive device includes a life jacket with a top, a bottom, and front and back floatation panels. The panels define a pair of side spaces between them which are each adapted for extending an arm therethrough. A flexible pouch having an interior compartment and an top opening into the interior compartment is coupled to the front and back floatation panels. A length of flexible line having opposite ends is disposable in the interior compartment of the pouch such that the ends of the flexible line are extended from the pouch. One of the ends of the flexible line has a fastening clip coupled thereto which is detachably attachable to a portion of the life jacket for securing the one end of the flexible line to the life jacket.

In these respects, the life jacket with flexible life line according to the present invention substantially departs from the conventional concepts and designs of the prior art, and in so doing provides an apparatus primarily developed for the purpose of allowing a user to have a life line conveniently located on their life jacket so that the line can be easily accessed during a rescue.

SUMMARY OF THE INVENTION

In view of the foregoing disadvantages inherent in the known types of life jackets now present in the prior art, the present invention provides a new life jacket with flexible life line construction wherein the same can be utilized for allowing a user to have a life line conveniently located on their life jacket so that the line can be easily accessed during a rescue.

The general purpose of the present invention, which will be described subsequently in greater detail, is to provide a new life jacket with flexible life line apparatus and method which has many of the advantages of the life jackets mentioned heretofore and many novel features that result in a new life jacket with flexible life line which is not anticipated, rendered obvious, suggested, or even implied by any of the prior art life jackets, either alone or in any combination thereof.

To attain this, the present invention generally comprises a life jacket with a top, a bottom, and front and back floatation panels. The panels define a pair of side spaces between them which are each adapted for extending an arm therethrough. A flexible pouch having an interior compartment and an top opening into the interior compartment is coupled to the front and back floatation panels. A length of flexible line having opposite ends is disposable in the interior compartment of the pouch such that the ends of the flexible line are extended from the pouch. One of the ends of the flexible line has a fastening clip coupled thereto which is detachably attachable to a portion of the life jacket for securing the one end of the flexible line to the life jacket.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new life jacket with flexible life line apparatus and method which has many of the advantages of the life jackets mentioned heretofore and many novel features that result in a new life jacket with flexible life line which is not anticipated, rendered obvious, suggested, or even implied by any of the prior art life jackets, either alone or in any combination thereof.

It is another object of the present invention to provide a new life jacket with flexible life line which may be easily and efficiently manufactured and marketed.

It is a further object of the present invention to provide a new life jacket with flexible life line which is of a durable and reliable construction.

An even further object of the present invention is to provide a new life jacket with flexible life line which is susceptible of a low cost of manufacture with regard to both materials and labor, and which accordingly is then susceptible of low prices of sale to the consuming public, thereby making such life jacket with flexible life line economically available to the buying public.

Still yet another object of the present invention is to provide a new life jacket with flexible life line which provides in the apparatuses and methods of the prior art some of the advantages thereof, while simultaneously overcoming some of the disadvantages normally associated therewith.

Still another object of the present invention is to provide a new life jacket with flexible life line for allowing a user to have a life line conveniently located on their life jacket so that the line can be easily accessed during a rescue.

Yet another object of the present invention is to provide a new life jacket with flexible life line which includes a life jacket with a top, a bottom, and front and back floatation panels. The panels define a pair of side spaces between them which are each adapted for extending an arm therethrough. A flexible pouch having an interior compartment and an top opening into the interior compartment is coupled to the front and back floatation panels. A length of flexible line having opposite ends is disposable in the interior compartment of the pouch such that the ends of the flexible line are extended from the pouch. One of the ends of the flexible line has a fastening clip coupled thereto which is detachably attachable to a portion of the life jacket for securing the one end of the flexible line to the life jacket.

Still yet another object of the present invention is to provide a new life jacket with flexible life line that allows a user to throw a life line attached to their life jacket to a person in distress in the water or in danger of drowning.

Even still another object of the present invention is to provide a new life jacket with flexible life line that allows the user to attach the flexible line to a structure so that a rescuer may be pulled back to safety by other rescuers if the rescuer is knocked out while saving a drowning person.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
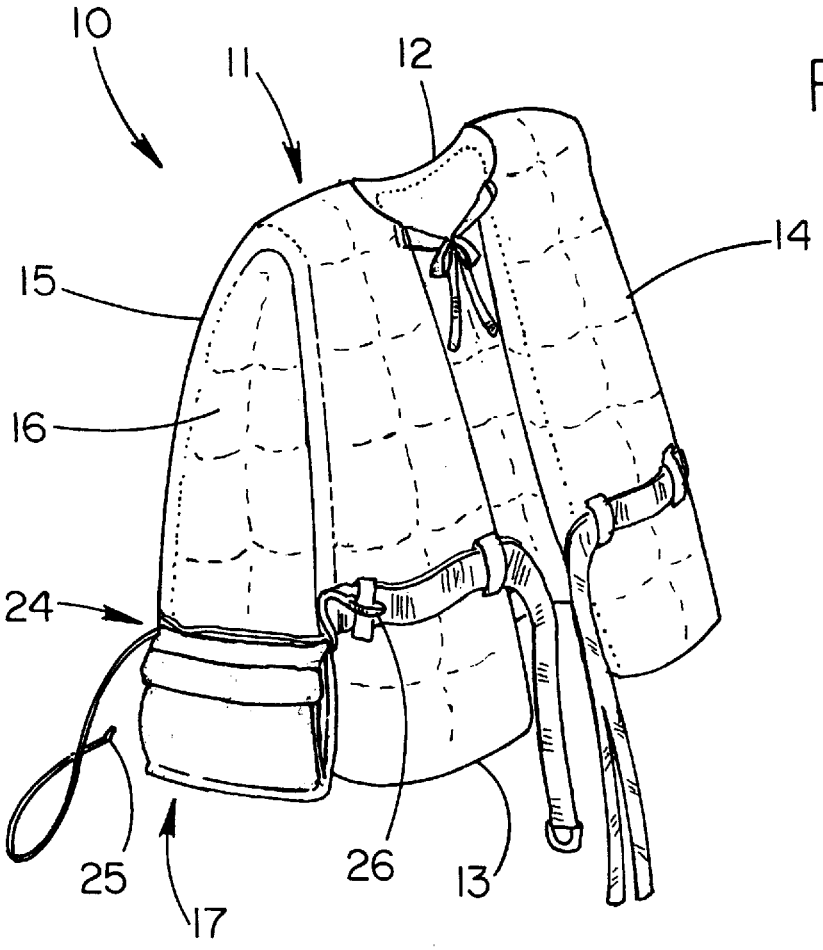
FIG. 1 is a schematic perspective view of a new life jacket with flexible life line according to the present invention.
Figure 2:
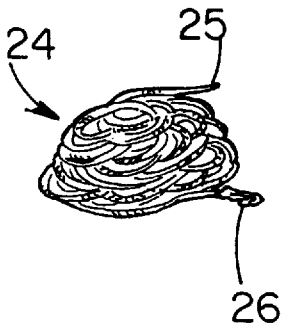
FIG. 2 is a schematic perspective view of the flexible line of the present invention.
Figure 3:
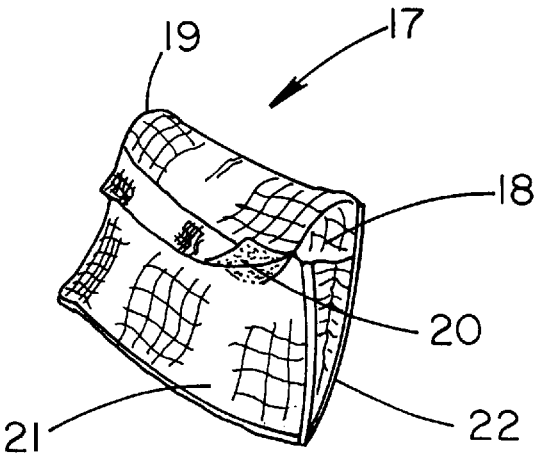
FIG. 3 is a schematic perspective view of the flexible mesh pouch of the present invention.

With reference now to the drawings, and in particular to FIGS. 1 through 3 thereof, a new life jacket with flexible life line embodying the principles and concepts of the present invention and generally designated by the reference numeral 10 will be described.

As best illustrated in FIGS. 1 through 3, the life jacket with flexible life line 10 generally comprises a life jacket 11 with a top 12, a bottom 13, and front and back floatation panels 14,15. The panels 14,15 define a pair of side spaces 16 between them which are each adapted for extending an arm therethrough. A flexible pouch 17 having an interior compartment and an top opening 18 into the interior compartment is coupled to the front and back floatation panels 14,15. A length of flexible line 24 having opposite ends 25,26 is disposable in the interior compartment of the pouch 17 such that the ends 25,26 of the flexible line 24 are extended from the pouch. One of the ends 26 of the flexible line 24 has a fastening clip coupled thereto which is detachably attachable to a portion of the life jacket 11 for securing the one end 26 of the flexible line to the life jacket 11.

In closer detail, the life jacket 11 has a top 12, a bottom 13, and front and back floatation panels 14,15. The panels 14,15 define a pair of side spaces 16 therebetween. Each side space 16 is adapted for extending an arm therethrough.

The flexible pouch 17 has an interior compartment and an top opening 18 into the interior compartment. The pouch 17 has a flexible cover 19 for generally covering the top opening 18 of the pouch 17. Preferably, a hook and loop fastener 20 detachably attaches the cover 19 over the top opening 18. The pouch 17 is positioned at one of the side openings 16 of the life jacket 11 towards the bottom 13 of the life jacket 11. The pouch 11 is positioned so that it is easily locatable to a wearer of the life jacket so that there is no delay in finding the flexible line. The pouch 17 is coupled to the front and back floatation panels 14,15. Preferably, the pouch 17 is detachably attached to the front and back floatation panels 14,15. Ideally, as illustrated in FIG. 3, the pouch 17 includes flexible front and back panels 21,22 coupled together along their perimeters. In this embodiment, the cover 19 of the pouch 17 extends from the back panel 22. Ideally, the pouch 17 is constructed from a mesh material so that water may easily pass through it and is not collected in the interior compartment.

The length of flexible line 24 has opposite ends 25,26 and is ideally at least 100 feet in length for providing an adequate length for a rescuer. The flexible line 24 is disposable in the interior compartment of the pouch 17 such that the ends 25,26 of the flexible line 24 are extended from the pouch 17. One of the ends 26 of the flexible line 24 has a fastening clip coupled thereto which is detachably attachable to a portion of the life jacket 11, such as a belt loop, for securing the one end 26 of the flexible line 24 to the life jacket 11. The other end 25 of the flexible line 24 is free so that it is attachable to a structure to secure the line between a user and a the structure or alternately, so that the free end 25 is throwable to a person by a wearer of the jacket.

In use, a rescuer wears the jacket 10 to rescue a person in a body of water. The wearer may secure the free end of the flexible line to a structure so that the wearer is secured to a structure when the wearer enters the body of water to rescue the person in the water. This way, if the wearer is injured or knocked out, the wearer can still be pulled out of the water by a person near the structure. Alternatively, the wearer can throw the free end of the flexible line at a person in the body of water. This way, the wearer does not have to get too close to the person in the body of water and risk injury or drowning by the person in the water.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lifejacket rescue device, comprising:

a life jacket adapted for floating a wearer on a surface of a body of water, said life jacket having a top, a bottom, and front and back floatation panels, said floatation panels containing sufficient buoyant material to float a person having a weight up to a pre-determined weight limit, said panels defining a pair of side spaces therebetween, each side space adapted for extending an arm therethrough;

a flexible pouch having an interior compartment and a top opening into said interior compartment being coupled to said front and back floatation panels;

a length of flexible line having opposite ends, said flexible line being disposable in said interior compartment of said pouch such that said ends of said flexible line are extended from said pouch, one of said ends of said flexible line having a fastening clip coupled thereto, said fastening clip being detachably attachable to a portion of said life jacket for securing said one end of said flexible line to said life jacket;

wherein said pouch has a flexible cover for generally covering said top opening of said pouch;

wherein a hook and loop fastener detachably attaches said cover over said top opening;

wherein said pouch comprises flexible front and back panels coupled together along their perimeters, said cover of said pouch being extended from said back panel; and wherein said pouch comprises a mesh material.

2. The life jacket of claim 1, wherein said pouch is positioned at one of said side openings of said life jacket towards said bottom of said life jacket.

3. The life jacket of claim 1, wherein said pouch is detachably coupled to said front and back floatation panels.

4. A lifejacket rescue device, comprising:

a life jacket having a top, a bottom, and front and back floatation panels, said panels defining a pair of side spaces therebetween, each side space adapted for extending an arm therethrough;

a flexible pouch having an interior compartment and an top opening into said interior compartment, said pouch having a flexible cover for generally covering said top opening of said pouch, wherein a hook and loop fastener detachably attaches said cover over said top opening, said pouch being positioned at one of said side openings of said life jacket towards said bottom of said life jacket, said pouch being coupled to said front and back floatation panels, wherein said pouch is detachably coupled to said front and back floatation panels, said pouch comprising flexible front and back panels coupled together along their perimeters, said cover of said pouch being extended from said back panel, wherein said pouch comprises a mesh material; and a length of flexible line having opposite ends, said flexible line being disposable in said interior compartment of said pouch such that said ends of said flexible line are extended from said pouch, one of said ends of said flexible line having a fastening clip coupled thereto, said fastening clip being detachably attachable to a portion of said life jacket for securing said one end of said flexible line to said life jacket.

* * * * *